United States Patent [19]

Canalizo

[11] 4,453,568

[45] Jun. 12, 1984

[54] GAS CONTROL SYSTEM

[75] Inventor: Carlos R. Canalizo, Dallas, Tex.

[73] Assignee: Otis Engineering Corporation, Dallas, Tex.

[21] Appl. No.: 390,204

[22] Filed: Jun. 21, 1982

[51] Int. Cl.[3] ..... F16K 31/126

[52] U.S. Cl. ..... 137/624.14; 137/624.15

[58] Field of Search ..... 137/624.14, 495, 624.15; 200/81.8

[56] References Cited

U.S. PATENT DOCUMENTS

| | | | |
|---|---|---|---|
| 2,626,569 | 1/1953 | Knudson | 200/81.8 |
| 3,276,469 | 10/1966 | Storm et al. | 137/624.14 |
| 4,323,741 | 4/1982 | Krohn | 200/81.8 |

*Primary Examiner*—Alan Cohan
*Assistant Examiner*—Mark Malkin
*Attorney, Agent, or Firm*—Vinson & Elkins

[57] ABSTRACT

An injection gas system for downhole equipment such as gas operated pumps or gas lift valves which shuts off injection gas at the surface in response to injection well pressure dropping to a selected amount and after a selected time to permit liquids from the well formation to rise in the well opens the shutoff valve and permits supply gas to be injected into the well. The control valve is closed by gas pressure in response to a Bourdon tube contracting with lower well pressure which activates a timer. As the timer runs down, it controls pressure to open the motor valve.

5 Claims, 4 Drawing Figures

GAS CONTROL SYSTEM

This invention relates to gas control systems and particularly to such systems which are responsive to pressure of the gas which is injected into the well.

Two frequently used methods of lifting liquids from a well involve the use of a gas pump in one method and a gas lift valve in the other method. See for instance my U.S. Pat. No. 3,362,347 issued Jan. 9, 1968, wherein the gas lift valves are closed in response to annulus ressure dropping to a selected value. The valves are maintained closed until annulus pressure rises to a selected value at which time they are permitted to open.

An object of this invention is to provide a surface control system which, upon injection well pressure dropping to a selected value, shuts off the source of supply gas to the well and begins operation of a timer. When the timer runs down, the control valve is opened permitting supply gas to be injected into the well.

Another object is to provide a timer controlled supply gas injection system in which supply gas is injected into the well a selected time after the injection gas pressure in the well reduces to a selected amount.

Another object is to provide a supply gas injection system which is surface controlled and a timer is utilized which permits the selection of a desired time for well fluids to build up in the well after the injected well pressure has reduced to a selected value permitting the well operator to adjust the timer to accommodate the rate of flow of liquids from a well.

Another object is to provide an injection control system for a gas operated well pump in which the response to rapid cycling of the pump due to a low head of liquid, the pump will shut off the injection supply gas and provide a selected time before injection supply gas is reintroduced into the well to permit a head of liquid to accumulate at the well pump.

Another object is to provide a supply gas injection system for wells equipped with gas lift valves in which in response to the injection pressure dropping at the end of a lifting cycle will shut off a supply of injection gas for a selected time to permit well liquids to accumulate in the well prior to again injecting supply gas into the well to begin a new lift cycle.

Other objects, features and advantages of the invention will be apparent from the drawings, the specifications and the claims.

In the drawings wherein an illustrative embodiment of this invention in shown and wherein like reference numerals indicate like parts:

Figure 4:
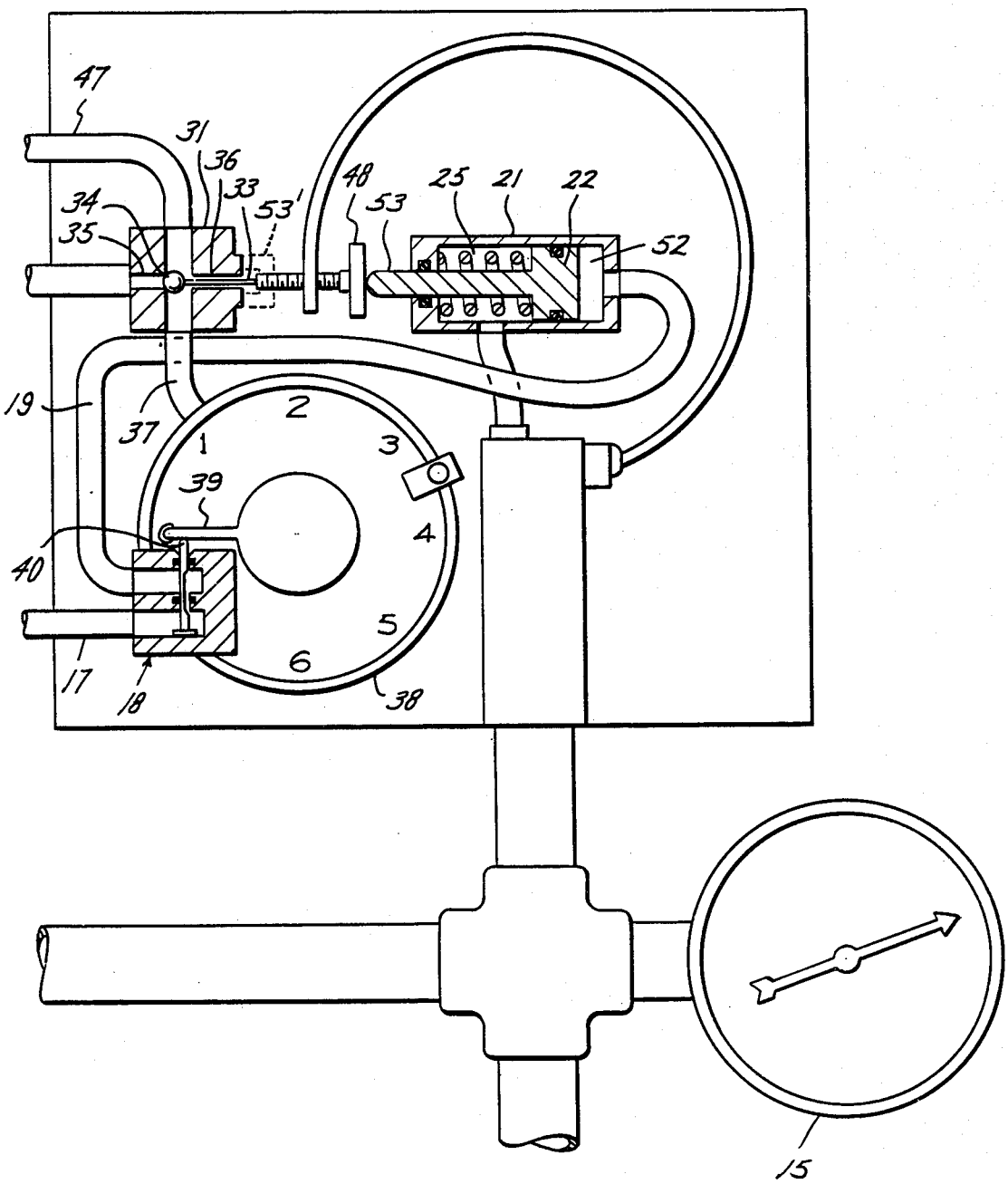

FIG. 4 is a view similar to FIG. 1 showing the clock to have reached its run down position and supply gas to have been removed from the clock and the motor valve by venting such gas to atmosphere and the reset plunger to have been actuated to reset and maintain the control valve in the venting position while pressure builds up in the well, which pressure will return the reset unit to its FIG. 1 condition.

Figure 1:
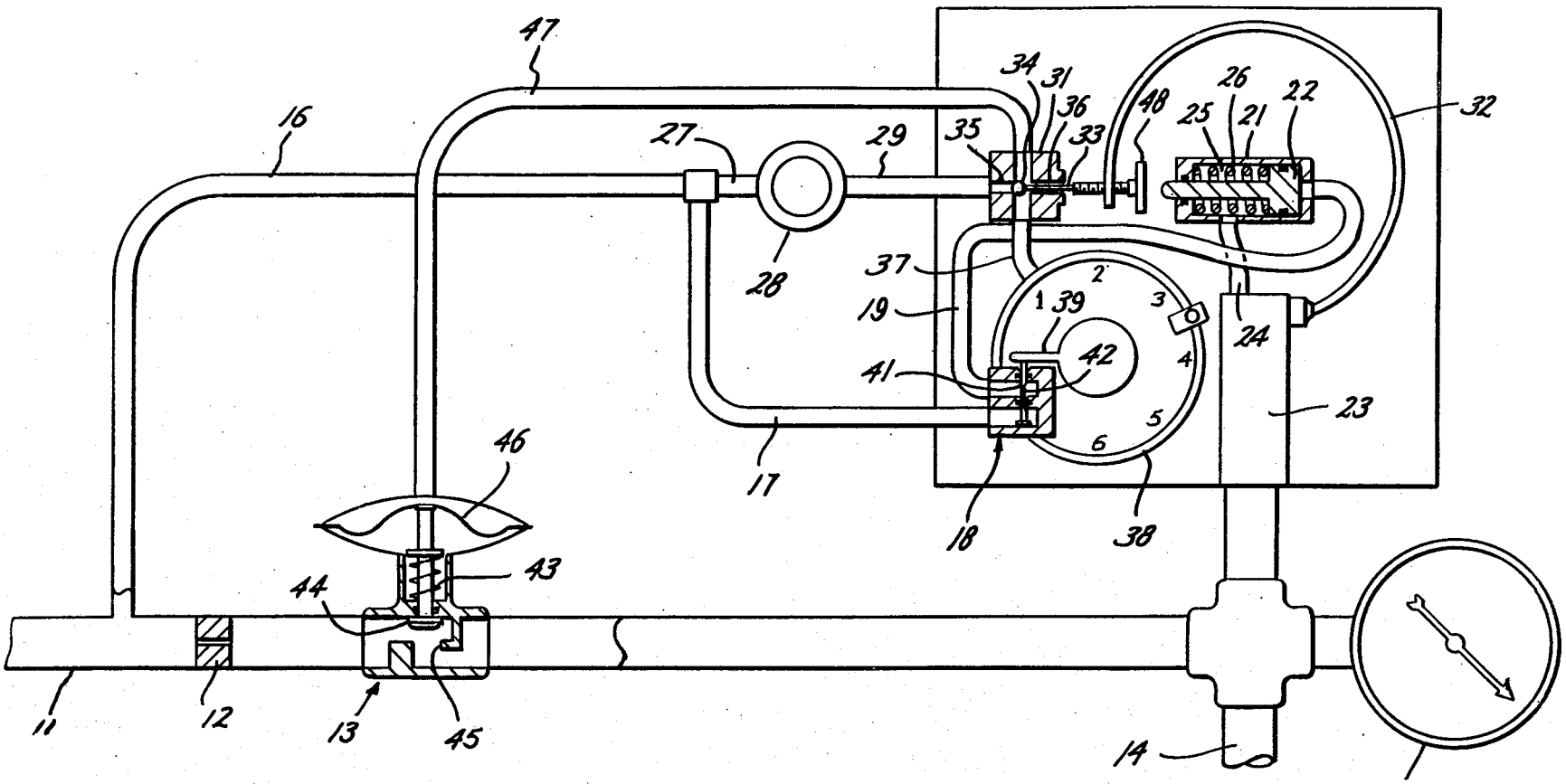
FIG. 1 is a schematic view partly in elevation and partly in cross-section of a control system constructed in accordance with this invention and showing the well under normal operating conditions.

Referring first to FIG. 1, a system is shown in normal operating condition for a gas pump in which a substantially constant back pressure is being maintained at the pump and a sufficient head of liquid is present at the pump so that it operates at a normal rate.

Supply gas is provided through line 11 and passes through the choke 12 and the open motor control valve indicated generally at 13 into the well supply pipe 14. The gauge 15 indicates the normal amount of pressure to be present in the injection pipe 14 which may be connected to a pump at the bottom of the well in any desired manner as by being connected to the tubing-casing annulus to inject gas into the annulus.

Supply gas from line 11 is introduced through the control conduit 16 into branch line 17 and thence through the two-way valve 18 to line 19 and thence to the reset 21 where the supply gas bears against the rest piston 22 urging it toward reset position.

The reset is held in an ineffective position by injection gas in line 23 being delivered through line 24 to chamber 25 in the reset device 21. The injection pressure together with spring 26 urge the piston to the position shown in FIG. 1. In normal operation the injection pressure together with the force of spring 26 will exert a force greater than the force exerted by supply gas pressure from line 19 and render the reset ineffective.

Supply gas from line 16 also flows into branch line 27 to regulator 28. The regulator reduces the supply gas to the low instrument gas pressure commonly employed in operating equipment. The supply gas from regulator 28 is delivered through line 29 to the control valve 31.

Pressure controlled actuator means having a pressure responsive member such as the Bourdon tube 32 receives gas from the pipe 23 which gas is at the injection well pressure. When this pressure is normal as shown in FIG. 1, the Bourdon tube is extended to engage valve stem 33 of valve 31 and hold the valve member 34 on its seat 35 to block flow of gas from the regulator 28 and also to vent gas through the vent port 36.

Also connected to the valve 31 is a conduit 37 which supplies gas to and operates the timer 38. The timer stop 39 is shown to be in a position in FIG. 1 which represents zero time which maintains the valve member 41 of valve 18 in its down position. The valve member 41 has a section 42 which is cut away to permit flow past the cut away section 42 from the conduit 17 to the conduit 19.

The motor control valve 13 is provided with a means such as spring 43 for urging the valve member 44 away from its seat 45. The diaphragm 46 in the valve is connected through conduit 47 with control valve 31 and with the valve 34 on seat 35 the diaphragm 46 is vented through line 47 and the vent passageway 36 to atmosphere.

Figure 2:
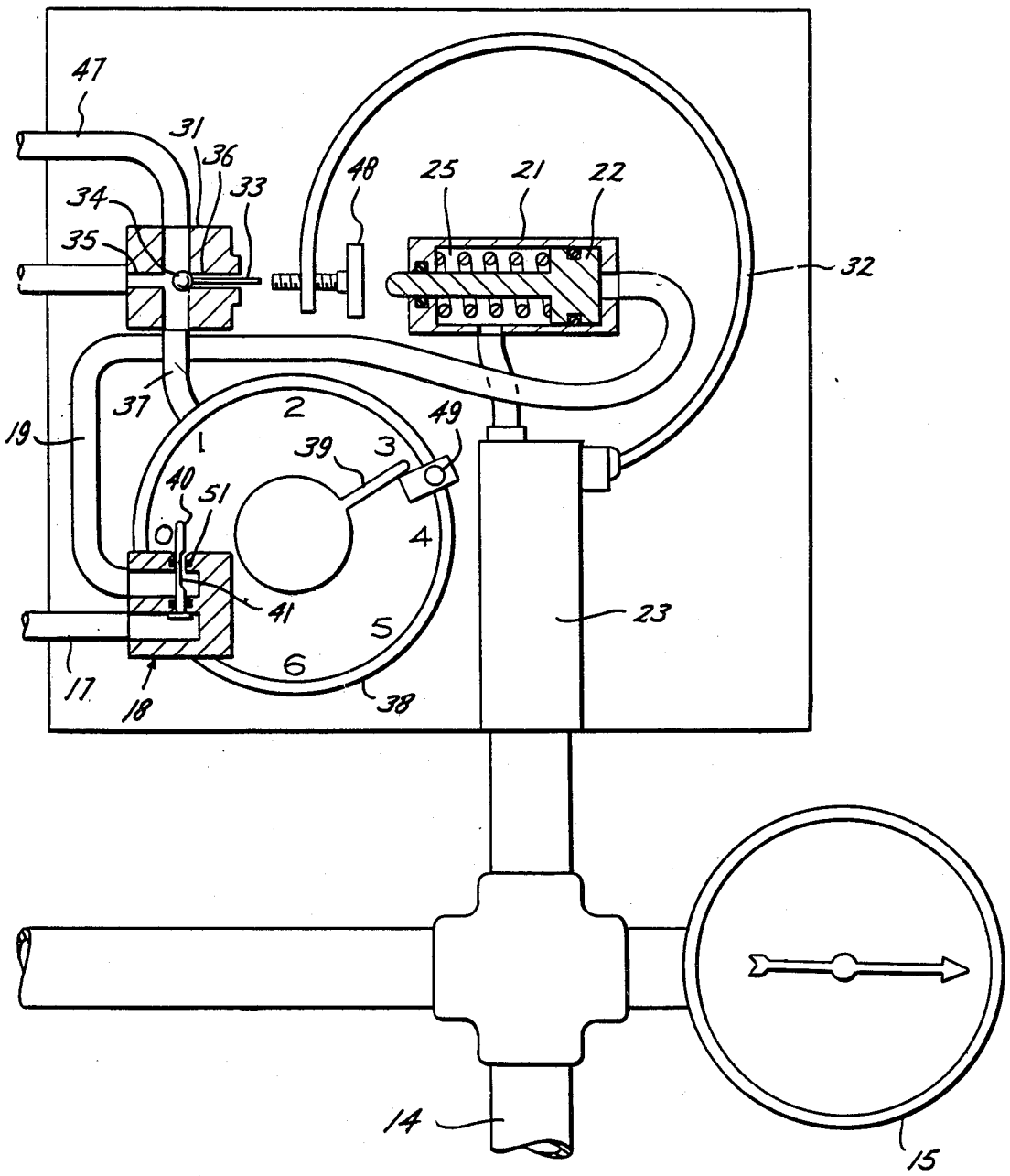
FIG. 2 is a view similar to FIG. 1 showing the position of the various components of the controller while pressure is being supplied to the motor valve controlling flow into the well to shut off the motor valve.

Referring to FIG. 2, the control system is shown when the injection pressure in the injection conduit 14 has dropped to a selected lower value as indicated in gauge 15. When this occurs, the pressure within the Bourdon tube 32 reduces and the Bourdon tube retracts and moves out of engagement with the valve stem 33 to permit the valve member 34 to seat on the vent 36 and close this vent. The Bourdon tube has an adjustable member 48 allowing the operator to select the pressure at which the valve stem 33 will be disengaged.

Figure 3:
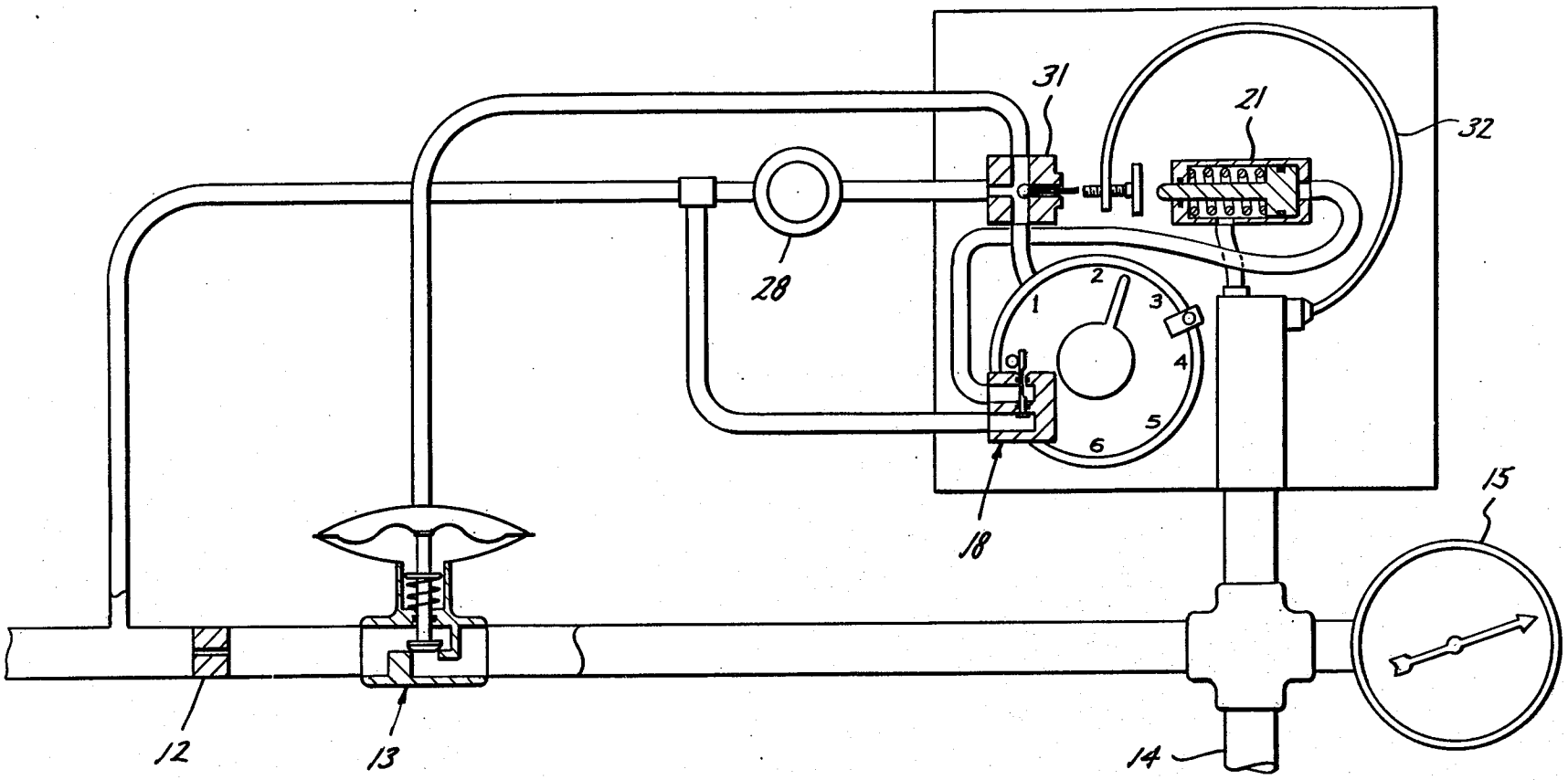
FIG. 3 is a view similar to FIG. 1 showing the motor control valve to be closed and the timer to be running down to permit liquids to rise in the well.

At the time that the Bourdon tube contracts enough to permit the valve 34 to close the vent opening 36, there is still enough pressure in line 23 to pressurize the chamber 25 of the reset unit 21 to an extent that will prevent the reset piston 22 from moving to the left as viewed in the drawing to a sufficient extent to reset the valve 31. As the valve 34 comes off of the instrument supply gas seat 35 and seats on the vent seat 36, instrument gas is supplied through line 47 to the motor valve 13 to close the motor valve. Instrument gas is also supplied through line 37 to the clock 38 to wind the clock until the stop 39 strikes the adjustable limiting member 49. This limiting member 49 may be set at any position on the clock to give the desired clock time for liquid to rise within the well. After the motor valve 13 closes, the pump will still cycle several times to lower the pressure within the well to a pressure at which the pump will stop cycling while the clock 34 runs down. At the time that the stop 39 was being wound by gas from valve 31, it released the valve member 41 of the valve indicated generally at 18 to shut off gas flow from line 17 to the reset unit 21 and as the valve member 41 moved upwardly upon being released by the clock stop 39, the cut away section 41 in the valve member moved upwardly to clear the upper seal 51 and vent the supply gas line 19 leading to the reset unit 21 through this seal 51. The venting of line 19 would occur immediately upon the valve 31 closing the vent passage to begin rewinding of the clock. Thus supply gas is removed from piston 22 of the reset unit before the pressure in chamber 25 is reduced due to the additional cycles of the pump after the motor control valve 13 had been closed. Thus, upon venting of line 19, the differential across the reset unit would hold the reset unit in inoperative position as shown in FIG. 2.

Where the control system is utilized with a gas lift valve, the system would be set such that the motor valve would be closed with the gas lift valve will open and pressure within the injection tube 14 would continue to drop a small amount. With either type of operational the pressure in injection pipe 14 would reduce after the motor valve 13 is closed as indicated by pressure gauge 15 in FIG. 3. In this Figure, the system is shown with its parts in the position shown in FIG. 2 except that the clock is shown to be running down and the pressure within the injection tube 14 to have dropped to a slightly lower level.

FIG. 4 shows the position of the components of the controller immediately after the clock has been run down and the reset unit 21 becomes operative to reset valve 31.

As the clock 38 reaches the zero position, the stop arm 39 engages the valve member 40 of valve 18 to close the vent opening in the valve and reestablish communication between the branch lines 17 and 19 to pressurize chamber 52 of the reset unit 21. As the injection pressure within chamber 25 is at the lower level indicated by gauge 15, the reset piston 22 extends its probe 53 to engage the adjusting stem 48 and move the Bourdon tube and stem 48 to its expanded position where it again engages the valve stem 33 and reseats the valve member 34 on seat 35. This blocks the flow of instrument air and at the same time communicates the clock reset conduit 37 and the motor valve conduit 47 with the vent passage 36. This action releases the pressure on diaphragm 46 and permits the motor valve to move to its open position as shown in FIG. 1. At the sample time, venting of the clock winding conduit 37 resets the clock and it can again be wound upon pressurizing of the passageway 37.

With the motor valve 13 in open position, the injection conduit 14 is again pressurized and as pressure comes up in this passageway, it increases as shown by gauge 15 in FIG. 1 and moves the reset piston 22 back to its retracted position as shown in FIG. 1. At the same time, the reset piston probe 53 disengages the Bourdon tube. The increase in pressure in the injection conduit 14 has pressurized the Bourdon tube 32 to the extent needed to hold it in the extended position prior to disengagement by the reset unit and the system will remain in the position shown in FIG. 1 with gas being injected into the well and operating the pump or the gas lift valve until pressure again reduces in the injection conduit 14.

If desired, a magnet indicated in dashed lines at 53 in FIG. 4 may be carried by the adjustable member 48 to engage the housing of valve 31. When the magnet is released from the housing of the valve 31, the Bourdon tube will move rapidly to contracted position releasing the valve stem 31 and permitting it to snap to a position engaging the vent seat 36.

As noted above, the increase in injection pressure will return the reset piston 22 to its fully retracted FIG. 1 position as the injection pressure comes up in line 14 and the system will continue to operate until the pressure of the injection gas drops. While this will be a continuing cycle with a gas lift valve, the gas operated pump may operate through many cycles before lower back pressure on the pump permits it to cycle rapidly and reduce the injection pressure.

The foregoing disclosure and description of the invention are illustrative and explanatory thereof and various changes in the size, shape and materials, as well as in the details of the illustrated construction, and various changes in the process may be made within the scope of the appended claims without departing from the spirit of the invention.

What is claimed is:

1. A system for controlling injection of gas into a well comprising, a supply gas line for injecting gas into a well, a gas operated motor valve controlling flow through said line, a choke in said line limiting flow therethrough when the motor valve is open, a gas operated timer, a source of gas for winding said timer and for closing said motor valve, valve means for alternatively venting and supplying gas to said motor valve and timer, pressure controlled actuator means for moving said valve means to gas supply position in response to a selected low injection gas pressure in the well, a reset unit for overriding said actuator means and moving said actuator means and thereby said valve means to gas venting position, said reset unit responsive to the differential between injection well pressure and supply gas pressure for overriding said actuator means and moving said actuator means and valve means to vent position and to the differential between injection well pressure and ambient pressure for releasing said actuator, and second valve means for alternately delivering supply gas to said reset unit in response to said timer being at zero time and venting supply gas from said reset unit in response to said timer being at other than zero time.

2. The system of claim 1 wherein said source of gas is a low pressure gas from a regulator receiving gas from the supply line.

3. The system of claim 1 wherein the actuator includes a magnet engaging said valve means so that the valve means are opened and closed in response to different injection well pressures.

4. The system of claim 3 wherein resilient means in the reset unit resist the unit overriding the actuator.

5. The system of claims 1, 2 or 3 wherein the actuator is a Bourdon tube.

* * * * *